US006234850B1

(12) United States Patent
Pandit et al.

(10) Patent No.: US 6,234,850 B1
(45) Date of Patent: May 22, 2001

(54) ELECTRICAL TERMINAL ARRANGEMENT

(75) Inventors: Anilkumar D. Pandit; M. Natarajan; A. Ramadevi, all of Bangalore; Rajesh Pandey, Delhi, all of (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/396,379

(22) Filed: Sep. 15, 1999

(51) Int. Cl.[7] ..... H01R 4/30; H01R 4/38
(52) U.S. Cl. ..... 439/801; 439/813
(58) Field of Search ..... 439/801, 811, 439/813

(56) References Cited

U.S. PATENT DOCUMENTS 970,087 * 9/1910 Murray ..... 439/811

* cited by examiner

*Primary Examiner*—Neil Abrams
*Assistant Examiner*—Javaid Nasri
(74) *Attorney, Agent, or Firm*—Nixon Peabody LLP; Robert M. Schulman; Carl B. Horton

(57) ABSTRACT

A terminal apparatus for connecting an electrical conductor to electric equipment. A terminal is electrically coupled to the electric equipment and has a hole formed therethrough. A first securing member has a head and a shaft passing through the hole formed in the terminal. A first conductor receiving area is defined between the head and a first side of the terminal. A second securing member selectively engages the shaft on a side of the terminal opposite the head of the first securing member. A second conductor receiving area is defined between the second securing member and a second side of the terminal. A holder is coupled to the terminal and disposed on a side of the terminal corresponding to the second securing member. The holder retains the second securing member at a position in which the second securing member can be engaged with an end of the shaft when the shaft is inserted through the hole formed in the terminal.

19 Claims, 2 Drawing Sheets

ELECTRICAL TERMINAL ARRANGEMENT

BACKGROUND OF THE INVENTION

The invention relates to a terminal arrangement for connecting an electrical conductor to electric equipment. More specifically, the invention relates to a terminal arrangement that permits two conductors to be easily fastened to a terminal with both conductors in contact with the terminal.

It is well known to couple electrical conductors to terminals of various electric equipment in a releaseable manner. For example, motors, transformers, generators, fuses, circuit breakers, switches and other electric equipment have screw terminals for releasably attaching electrical conductors thereto. Typically, such terminals consist of a relatively flat strip or plate having a hole formed therein. A screw is threaded through the hole and pressure plate is disposed around a shaft of the screw between the terminal and a head of the screw. An end of the conductor is disposed between the pressure plate and the terminal and the screw is tightened to push the pressure plate against the conductor and thus clamp the conductor between the pressure plate and the terminal. Often the conductor is a wire with a lug of a predefined shape attached to an end thereof and the lug is clamped against the terminal. The pressure plate can be omitted and the end of the conductor can be clamped between the head of the screw and terminal.

In the conventional screw terminals of the type described above, if two conductors are to be connected to a single terminal, the two conductors are stacked on one another and clamped against the terminal. Accordingly, only one of the conductors is directly in contact with the terminal. This results in the full terminal current being transmitted through the single joining surface between the conductor adjacent the terminal and thus excessive heating can occur because of the minimized area through which current flows. Further, current flow through the conductors may be undesirably uneven. Also, the conductors often are not are securely clamped against the terminal because of the stacked arrangement thereof. Further, when one conductor is to be removed from the terminal, both conductors must be removed and the conductor to be attached to the terminal must be repositioned in a clamping area. If two separate screws are provided in a terminal for connecting two conductors thereto, the terminal becomes relatively large and complex and the conductors may interfere with one another.

SUMMARY OF THE INVENTION

To overcome the above-noted disadvantages in conventional screw terminals, the invention relates to a terminal for facilitating attachment of two conductors to a single terminal. The invention is an apparatus for connecting an electrical conductor to electric equipment. The apparatus comprises, a terminal electrically coupled to the electric equipment and having a hole formed therethrough. A first securing member has a head and a shaft passing through the hole formed in the terminal. A first conductor receiving area is defined between the head and a first side of the terminal. A second securing member selectively engages the shaft on a side of the terminal opposite the head of the first securing member. A second conductor receiving area is defined between the second securing member and a second side of the terminal. A holder is coupled to the terminal and disposed on a side of the terminal corresponding to the second securing member. The holder retains the second securing member at a position in which the second securing member can be engaged with an end of the shaft when the shaft is inserted through the hole formed in the terminal.

BRIEF DESCRIPTION OF THE DRAWING

The invention will be described through a preferred embodiment and the attached drawing in which.

DETAILED DESCRIPTION OF THE PREFERRED EMBODIMENT

Figure 1:
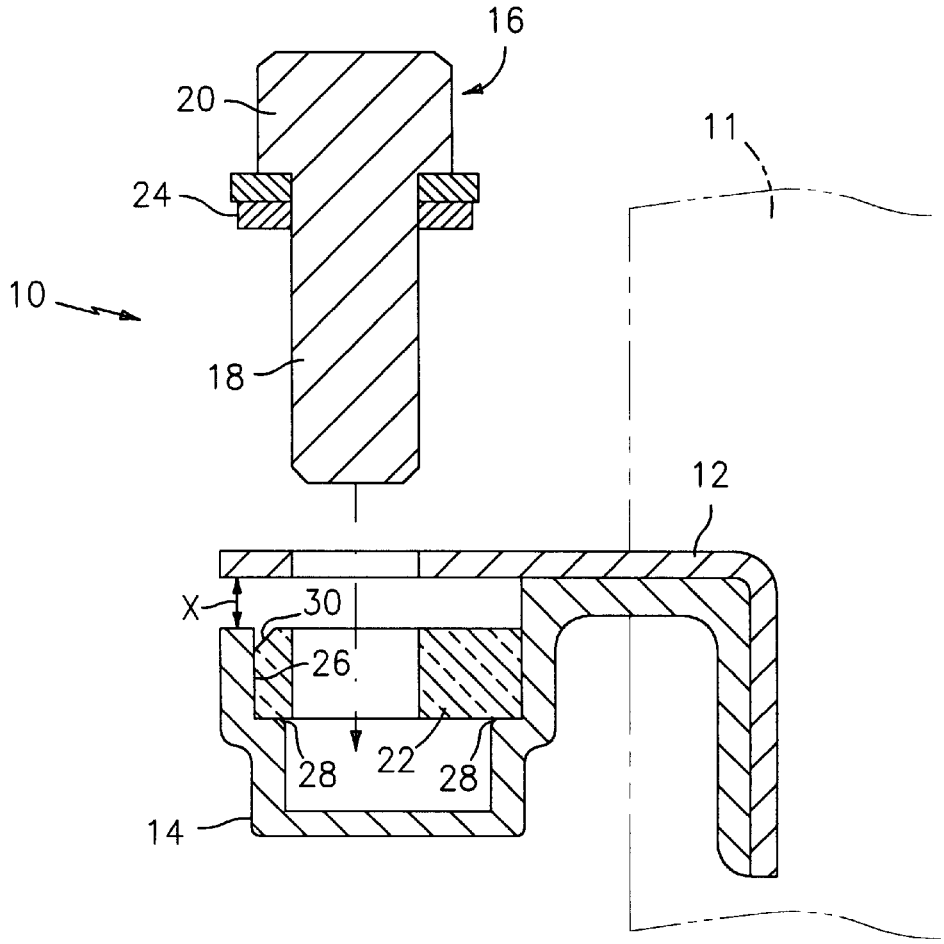
FIG. 1 is a sectional view of the preferred embodiment with the screw removed for insertion of conductors.
Figure 4:
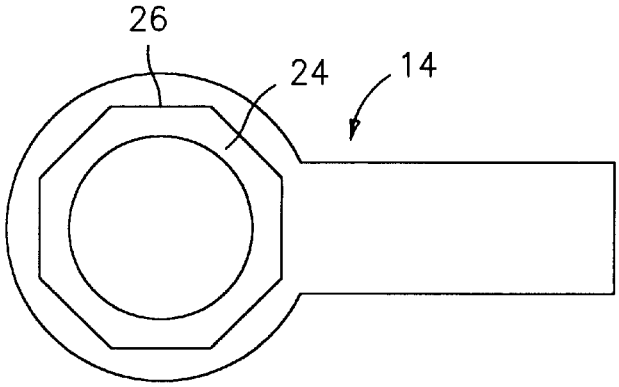
FIG. 4 is a top view of the holder of the preferred embodiment not attached to the terminal or electrical equipment.
Figure 2:
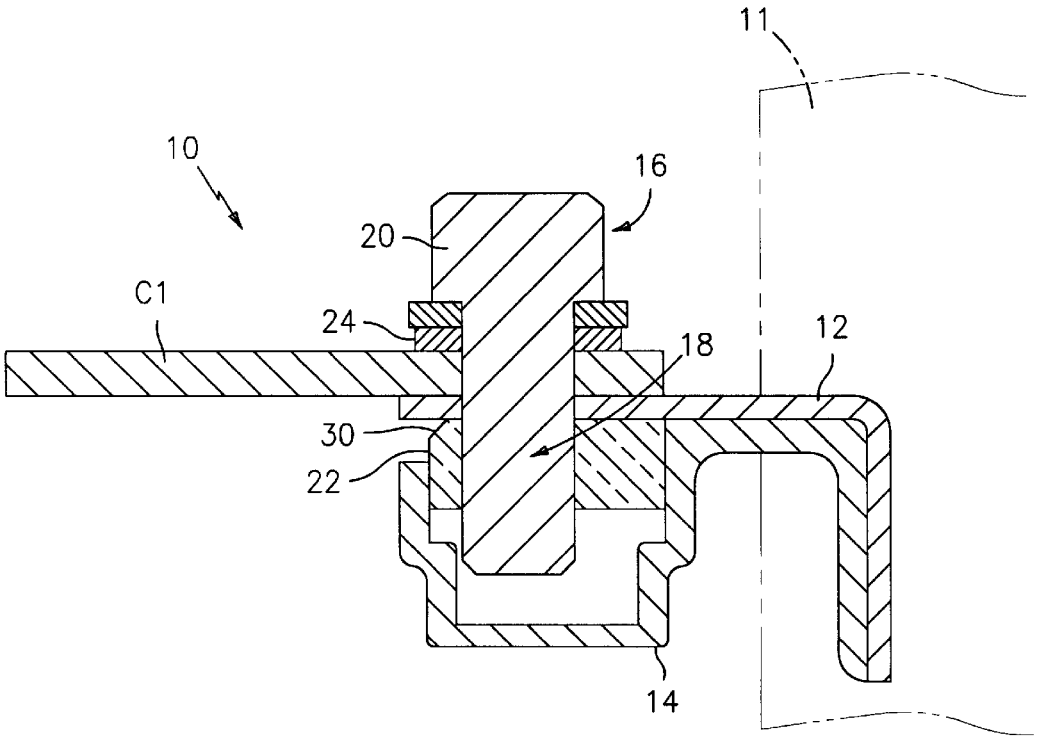
FIG. 2 is a sectional view of the preferred embodiment used with one conductor.
Figure 3:
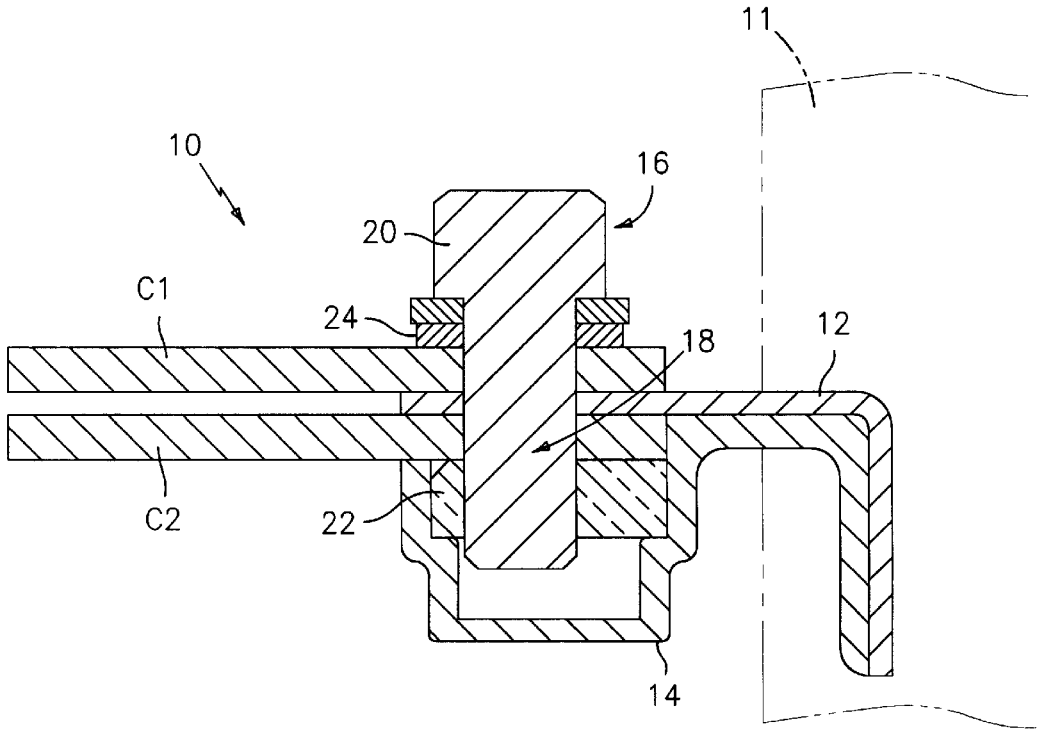
FIG. 3 is a sectional view of the preferred embodiment used with two conductors.

FIGS. 1–3 illustrate the preferred embodiment of the invention. Terminal apparatus 10 includes terminal 12 connected to electric equipment 11. Electric equipment 11 can be any type of device requiring connection of an electric conductor thereto for power, control, or any other purpose and thus electric equipment 11 is illustrated schematically. For example, electric equipment 11, can be a motor, transformer, generator, fuse, circuit breaker, switch, bus bar, or other electric equipment. Terminal 12 includes a flat portion extending to an exterior of electric equipment 11.

Holder 14, in the form of a cup in the preferred embodiment, is secured to a lower side of terminal 12, is secured to equipment 11, or is secured to both equipment 11 and a lower side of terminal 12. However, holder 14 can be secured in any manner that fixedly or movably couples holder 14 to terminal 12 to accomplish the function described below. Screw 16 has head 20 that is larger than a hole formed in terminal 12 and shaft 18 that is adapted to pass through the hole formed in terminal 12. When shaft 18 of screw 16 is inserted through the hole, head 20 of screw 16 is disposed on an upper side of terminal 12 and an end of shaft 18 enters a cavity defined by holder 14 on a lower side of terminal 12, as illustrated in FIGS. 2 and 3. Nut 22 includes a female thread and is adapted to be threadably engaged to a male thread formed on shaft 18 of screw 16. As will be apparent from the description below, screw 16 serves as a first securing member and nut 22 serves as a second securing member.

Compression member 24 can be disposed on shaft 18 of screw 16 near head 20 as illustrated. Compression member 24 serves to distribute the forces of head 20 over a relatively large area of a conductor when a conductor is received in a receiving area between an upper surface of terminal 12 and head 20. Compression member 24 can be a plate, a washer, a bushing, or the like and may be omitted if the size of head 20 is adequate for distributing forces. Compression member 24 can be fixedly coupled to screw 16 or can be separate therefrom.

As best illustrated in FIG. 1, nut 22 is held captive in holder 14 to be positioned for receiving shaft 18 in a hole formed therein. The inner dimensions, i.e. a cavity size, of holder 14 are such that nut 22 can move up and down in the drawing but cannot escape the confines of holder 14 and is retained in an orientation in which the hole formed in nut 22 is positioned to receive shaft 18 therein. Also, nut 22 is prevented from turning substantially about an axis extending through the hole formed therein. For example, flat portions 26 defined on an inner surface of holder 14 can correspond to flat sides of nut 22, which can be octagonal, square or of any shape, to prevent turning of nut 22, as illustrated in FIG.

4. Shoulder portions 28 are defined in the cavity formed in holder 14 to define a first upper portion of the cavity in which nut 22 can be accommodated and a second lower portion of the cavity that is smaller than the first portion to prevent nut 22 from entering therein. When screw 16 is not engaged with nut 22, as illustrated in FIG. 1, nut 22 rests on shoulder portions 28.

To secure a single conductor to terminal 12 and thus cause the conductor to electrically communicate with components of equipment 11, conductor C1, having a substantially flat end portion with a hole formed therein, is positioned on the upper surface of terminal 12 with the hole of conductor C1 aligned with the hole formed in terminal 12. Subsequently, shaft 18 is inserted into the aligned holes and threads formed on an end of shaft 18 are caused to abut against threads formed in nut 22. In this position, head 20 of screw 16 can be turned to cause nut 22 to be threaded on shaft 18 of screw 16. In this manner, nut 22 is raised in holder 14 and eventually abuts against a lower surface of terminal 12 as illustrated in FIG. 2. Further turning of head 20 will place shaft 18 in tension to secure conductor C1 to terminal 12 with conductor C1 being pressed between compression member 24 and an upper surface of terminal 12. As illustrated in FIG. 2, an end portion of shaft 18 enters the small lower portion of the cavity formed in holder 14.

Note that holder 14 is formed to define a space between an edge thereof and terminal 12 as indicated at X in FIG. 1. The dimensions of space X are adequate to permit a conductor to be passed therethrough. This configuration permits a second conductor to be received in a receiving area below terminal 12 thereby permitting two conductors to be secured to terminal 12 in the manner described below. When nut 22 rests on shoulder portion 28, an upper surface of nut 22 is at substantially the same level as the edge of holder 14 that defines space X. Beveled or chamfered portion 30 is defined on nut 22 to facilitate insertion of a conductor into space X. Attachment of two conductors is accomplished in a manner similar to that described above for one conductor. However, prior to inserting screw 16 through the holes of conductor C1 and terminal 12, a flat end of conductor C2, having a hole formed therein, is inserted into space x and received in an area below terminal 12 so that the hole in conductor C2 is aligned with holes in conductor C1 and terminal 12. Subsequently, shaft 18 is inserted through the holes in conductor C1, terminal 12, and conductor C2 and threads formed on an end of shaft 18 are caused to abut against threads formed in nut 22. In this position, head 20 of screw 16 can be turned to cause nut 22 to be threaded on shaft 18 of screw 16. In this manner, nut 22 is raised in holder 14 and eventually abuts against a lower surface of conductor C2 as illustrated in FIG. 3. Further turning of head 20 will place shaft 18 in tension to secure conductors C1 and C2 to terminal 12 with conductor C1 being pressed between compression member 24 and an upper surface of terminal 12 and conductor C2 being pressed between nut 22 and a lower surface of terminal 12. As illustrated in FIG. 2, an end portion of shaft 18 enters the small lower portion of the cavity formed in holder 14.

The invention permits one or two conductors to be terminated to different sides of the same terminal so that both conductors are directly in contact with the terminal. Also, it is not necessary to access the nut and manually bold the nut in place during termination. A single conductor can be secured to either side of the terminal. The dimensions of the holder can be configured to restrain sideways movement of a conductor secured to the side of the terminal on which the holder is located. Because the conductors are secured to different sides of the terminal, a higher clamping force can be achieved and thus the invention is well suited for high current applications.

The preferred embodiment was described in terms of relative directions of "up" and "down" and "upper" and "lower". However, the invention can be oriented in any manner and thus these terms are not intended to limit the structure of the invention. The holder of the preferred embodiment is round and cup-like. However, the holder can be of any shape or configuration that restricts movement of the nut in the manner described above. The opening defined by the cup for insertion of a conductor can be of any shape or configuration and can extend in any direction to permit various relative orientations between two conductors secured to the terminal. For example, the conductors can extend perpendicular to one another after being secured to the terminal.

The invention can be used to couple one, two, or more conductors to electrical equipment or to one another. For example, the invention need not be coupled to electrical apparatus and can be used to join two or more conductors to one another, such as in a splice. Therefore, the phrase "electrical equipment" as used herein refers to any object to which an electrical conductor is to be attached and includes wires, bus bars, and the like. The invention can be used to connect wires to bus bars or to connect bus bars to one another. The preferred embodiment uses a screw and a nut as the securing members. However, any type of securing members can be used in the invention. For example, the securing members can include coaxial shafts that pressure fit with one another or mate through a bayonet configuration. Any securing members that are capable of being selectively attached to one another can be used.

The conductors can be a round wire with a flat end or a wire with a flat lug thereon. The lug can be a spade type lug with a hole therethrough or a Y-shaped lug. In the case of a Y-shaped lug, it will be apparent the screw need not be removed from the nut during insertion of the conductors into the receiving areas on the terminal. Further, the wire and any lug can be of any shape and the receiving areas can be configured to accept any shape of wire or lug.

The invention has been described through a preferred embodiment. However, various modifications can be made without departing from the scope of the invention as defined by the appended claims.

What is claimed is:

1. An apparatus for connecting an electrical conductor to an electric equipment, said apparatus comprising:

a terminal electrically coupled to the electric equipment and having a hole formed therethrough;

a first securing member having a head and a shaft passing through the hole formed in said terminal, a first conductor receiving area being defined between said head and a first side of said terminal;

a second securing member selectively engageable with said shaft on a side of said terminal opposite said head of said first securing member, a second conductor receiving area being defined between said second securing member and a second side of said terminal; and a holder coupled to said terminal and disposed on a side of said terminal corresponding to said second securing member, said holder retaining said second securing member at a position in which said second securing member can be engaged with an end of said shaft when said shaft is inserted through the hole formed in said terminal.

2. The apparatus as recited in claim 1 wherein said first securing member comprises a threaded screw, and said second securing member comprises a nut threadably engageable with said screw on a side of said terminal opposite said head whereby said nut moves along said shaft in response to turning of said screw.

3. The apparatus as recited in claim 2, wherein said holder comprises a cupped portion having a cavity defined therein, shoulder portions being defined in the cavity to divide the cavity into a first portion having dimensions capable of receiving said nut and a second portion having dimensions smaller than the first portion to prevent said nut from entering the second portion, the end of said shaft extending into the second portion.

4. The apparatus as recited in claim 3, wherein a space is defined between an edge of said holder and said second side of said terminal to provide access to said second conductor receiving area.

5. The apparatus as recited in claim 4, further comprising a bushing disposed on said shaft between said head and said first side of said terminal, said first conductor receiving area being defined between said bushing and said first side of said terminal.

6. The apparatus as recited in claim 4, wherein a first surface of said nut which opposes said second side of said terminal is at substantially the same level as said edge of said holder when a second surface of said nut which is opposite said first surface of said nut is in contact with said shoulder portions.

7. The apparatus as recited in claim 6, wherein a beveled portion is defined on said nut proximate said space.

8. An apparatus for connecting an electrical conductor to electric equipment, said apparatus comprising:

a terminal electrically coupled to the electric equipment and having a hole formed therethrough;

a screw having a head and a shaft passing through the hole formed in said terminal, a first conductor receiving area being defined between said head and a first side of said terminal;

a nut selectively engageable with said shaft on a side of said terminal opposite said head of said screw, a second conductor receiving area being defined between said nut and a second side of said terminal; and a holder including a cupped portion coupled to said terminal and disposed on a side of said terminal corresponding to said nut, said cupped portion retaining said nut at a position in which said nut can be engaged with an end of said shaft when said shaft is inserted through the hole formed in said terminal.

9. The apparatus as recited in claim 8, wherein said cupped portion has a cavity defined therein, shoulder portions being defined in the cavity to divide the cavity into a first portion having dimensions capable of receiving said nut and a second portion having dimensions smaller than the first portion to prevent said nut from entering the second portion, the end of said shaft extending into the second portion.

10. The apparatus as recited in claim 9, wherein a space is defined between an edge of said cupped portion and said second side of said terminal to provide access to said second conductor receiving area.

11. The apparatus as recited in claim 10, further comprising a bushing disposed on said shaft between said head and said first side of said terminal, said first conductor receiving area being defined between said bushing and said first side of said terminal.

12. The apparatus as recited in claim 10, wherein a first surface of said nut which opposes said second side of said terminal is at substantially the same level as said edge of said cupped portion when a second surface of said nut which is opposite said first surface of said nut is in contact with said shoulder portions.

13. The apparatus as recited in claim 12, wherein a beveled portion is defined on said nut proximate said space.

14. An apparatus for connecting an electrical conductor to electric equipment, said apparatus comprising:

a terminal electrically coupled to the electric equipment;

means for securing a first conductor on a first side of said terminal;

means for securing a second conductor on a second side of said terminal; and means for holding said means for securing a second conductor at a position in which said means for securing a second conductor can be engaged with said means for securing a first conductor.

15. The apparatus as recited in claim 14 wherein said means for securing a first conductor comprises a threaded screw having a shaft and a head and said means for securing a second conductor comprises a nut threadably engageable with said shaft on a side of said terminal opposite said head when said shaft passes through a hole formed in said terminal whereby said nut moves along said shaft in response to turning of said screw.

16. The apparatus as recited in claim 15, wherein said means for holding comprises a cupped portion having a cavity defined therein, shoulder portions being defined in the cavity to divide the cavity into a first portion having dimensions capable of receiving said nut and a second portion having dimensions smaller than the first portion to prevent said nut from entering the second portion, the end of said shaft extending into the second portion.

17. The apparatus as recited in claim 16, wherein a space is defined between an edge of said cupped portion and said terminal.

18. The apparatus as recited in claim 17, further comprising a bushing disposed on said shaft between said head and said terminal.

19. The apparatus as recited in claim 17, wherein a beveled portion is defined on said nut proximate said space.

* * * * *